United States Patent [19]

Ford et al.

[11] Patent Number: 4,877,093

[45] Date of Patent: Oct. 31, 1989

[54] SPRING ACTUATED POWER SWIVEL SUPPORT ROLLERS

[75] Inventors: David B. Ford, Frisco; James E. Lynch, Dallas, both of Tex.; Leroy R. Rateike, Rockford, Ill.

[73] Assignee: National-Oilwell, Houston, Tex.

[21] Appl. No.: 163,583

[22] Filed: Mar. 3, 1988

[51] Int. Cl.[4] ..... E21B 3/02

[52] U.S. Cl. ..... 175/113; 175/162; 175/220; 187/95; 384/54; 384/57

[58] Field of Search ..... 175/220, 162, 113, 85; 173/162.1, 164, 44; 384/54, 55, 57; 187/95; 267/137, 160, 163

[56] References Cited

U.S. PATENT DOCUMENTS

| | | | |
|---|---|---|---|
| 3,340,938 | 9/1967 | Wilson | 173/44 X |
| 3,994,350 | 11/1976 | Smith et al. | 175/87 |
| 4,244,628 | 1/1981 | Nayler et al. | 385/54 |
| 4,314,611 | 2/1982 | Willis | 173/57 |
| 4,345,864 | 8/1982 | Smith, Jr. et al. | 414/22 |
| 4,421,179 | 12/1983 | Boyadjieff | 173/44 |
| 4,570,706 | 2/1986 | Pugnet | 175/162 X |
| 4,589,503 | 5/1986 | Johnson et al. | 175/113 |
| 4,752,102 | 6/1988 | Rasmussen | 187/95 X |

FOREIGN PATENT DOCUMENTS

| | | | |
|---|---|---|---|
| 234880 | 9/1987 | European Pat. Off. | 175/85 |
| 3634502 | 4/1987 | Fed. Rep. of Germany | 175/220 |
| 2178780 | 2/1876 | United Kingdom . | |
| 911444 | 11/1962 | United Kingdom | 187/95 |

*Primary Examiner*—Hoang C. Dang

*Attorney, Agent, or Firm*—R. J. Bunyard; L. A. Fillnow; R. H. Johnson

[57] ABSTRACT

A spring actuated guide system for a top driven drilling machine. Rollers for guiding the drilling machine are mounted onto springs which urge the rollers into contact with support surfaces on parallel tracks within a derrick. If the tracks become misaligned, the springs allow for the misalignment with low roller loads thereby providing limited rotational movement of the drilling machine relative to the tracks. Premature failure of the roller bearings is prevented and wear on the rollers and tracks is reduced.

11 Claims, 7 Drawing Sheets

SPRING ACTUATED POWER SWIVEL SUPPORT ROLLERS

BACKGROUND OF THE INVENTION

This invention relates to a system for vertically guiding a top driven drilling machine for use in a derrick. More particularly, the invention includes a spring mounted means for cooperating with a guide track to resist torque generated loads of a drill motor when drilling a well.

Conventional rotary drilling requires a rotary table, a motor mounted on the rig floor for rotating the table, a kelly and a kelly bushing. These drilling systems are being replaced by "top drive" drilling machines which rotate a drill string from above the rig floor using a drilling motor incorporated with a swivel bearing supported by a traveling block. This later drill motor-swivel bearing combination will herein be referred to as a power swivel.

A power swivel can be installed in a standard derrick or mast, hereafter referred to as a derrick. The drilling motor is connected to the drill string by a cylindrical stem or sub assembly extending downwardly from the drilling motor. Drilling is accomplished by the powered rotation of a suspended string of drill pipe. A cutting tool or bit is at the bottom end of the drill string which, through the rotational energy supplied by the power swivel, cuts through the earth's formations and deepens the well.

It is well known to mount a power swivel onto a carriage for support within a derrick. Rollers are rigidly mounted onto the carriage with the carriage guided by a pair of parallel rails or tracks vertically aligned along the axis of the derrick. Unlike conventional drilling machines where the drill motor is located on the rig floor, the tracks for top drive drilling machines must react to the torque loads generated by the drill motor during drilling. Drill motors up to 1000 HP are used and can develop intermediate torque up to 32000 ft-lbs. (43400 Joules) or more.

A guide system for the power swivel is needed to reduce impact loading and to allow for small abberations in the track. In the manufacture of the beams used for the track, it is not possible to maintain the same parallel distance between flanges or opposing sides of a beam. For this reason, if the rollers were spaced in such a manner as to contact the sides of the track at any one position on the track, there would be other positions where they would either not be in contact with both sides of the track or they would be too wide to fit in the track. If the space were not as wide as required for the rollers, the loads generated on the rollers by forcing them into that space would be great and would most assuredly lead to the untimely failure of the rollers. For this reason, it has been the practice in the past to space the rollers such that there is always some gap between the rollers and the flanges or sides of the track.

Leaving a gap between the rollers and the track causes the rollers to be subjected to impact loading. When the rollers are not directly against the track, any load which tends to rotate the power swivel is not resisted, causing the power swivel to rotate freely for a brief period of time. It is well known rotational forces vary greatly as a well is being drilled resulting in substantial motion of the power swivel. When the power swivel rotates far enough, the rollers will come into contact with the track. The momentum which exists in the power swivel due to its rotational energy it has gained from its brief free rotation is subsequently dissipated very rapidly under these conditions and results in high forces being applied to the track and the rollers.

Accordingly, there is a need for an improved guide system for top drive drilling machines. The guide system needs to provide limited controlled rotation between the drill motor and the track so that the impact loading to the track is reduced. Our invention overcomes this problem by mounting each support roller onto a spring with the spring urging each roller into continuous contact with the track. With the rollers urged against the track and a yieldingly limited rotation of the power swivel frame provided, reduced loads pass into the structural support and impact on the rollers and track is reduced. If the rollers are urged into contact with the tracks by the use of springs as the power swivel rotates, the power swivel is constantly required to overcome the constantly increasing force of the springs. This deflection of the springs requires work thus steadily dissipating the energy over time as opposed to dissipating the energy very quickly. Accordingly, forces applied to the track and rollers are reduced and impact to the track and rollers would be eliminated.

BRIEF DESCRIPTION OF THE INVENTION

Our invention relates to a power swivel for vertical suspension within a derrick that is guided by a track aligned along the longitudinal axis of the derrick. Means for guiding the power swivel includes a spring which prevents free rotation of the power swivel relative to the guide track during rotation of a drill string. The spring provides controlled rotation of the power swivel to prevent impact loading to the guide track.

It is a principal object of the invention to allow limited rotation of a power swivel relative to the vertical axis of a derrick during drilling of a well.

Another object of the invention is to urge a support roller into contact with a support surface on the guide track.

An advantage of the invention is longer life to the guide system and quieter operation during drilling.

Another advantage is constant absorption of energy of the spring reducing force and eliminating impact to the support roller and track.

A further advantage is cost reduction because a lighter gauge track can be used and maintenance has been reduced.

The above and other objects, features and advantages of our invention will become apparent upon consideration of the detailed description and appended drawing.

DETAILED DESCRIPTION OF THE PREFERRED EMBODIMENT

Figure 1:
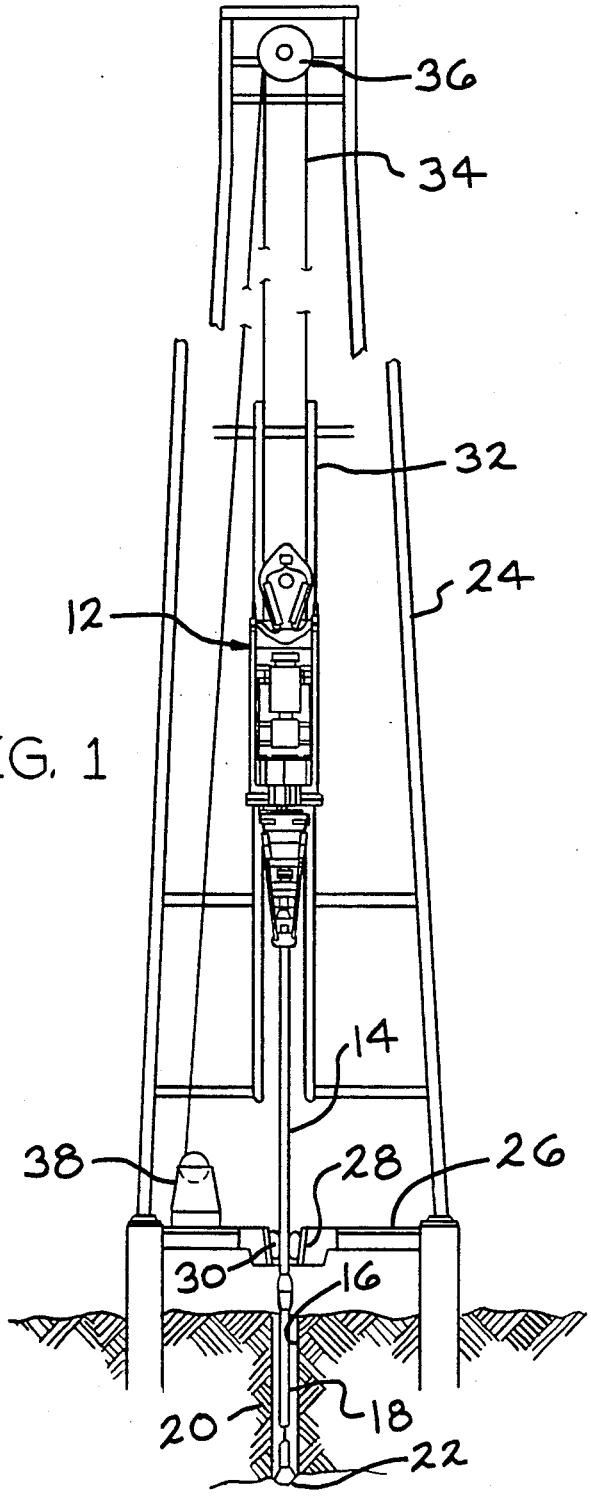
FIG. 1 is a schematic view of a power swivel incorporating the invention.

Referring to FIG. 1, reference numeral 12 denotes a schematic of a top driven drilling machine or power swivel and a stand of pipe 14 coupled to a drill string 18 by a tool joint 16. Drill string 18 is rotated into a well 20 with a drill bit 22 connected to the bottom end of drill string 18. Pipe stand 14 may include one or more lengths of drill pipe. Power swivel 12 is vertically suspended in a derrick 24 including a floor 26 having a slip bowl 28 and slips 30. Power swivel 12 is guided during vertical movement by a pair of parallel tracks 32 and suspended from a wire rope 34 reeved over a crown block 36 with rope 34 wrapped around a drawworks 38.

Figure 2:
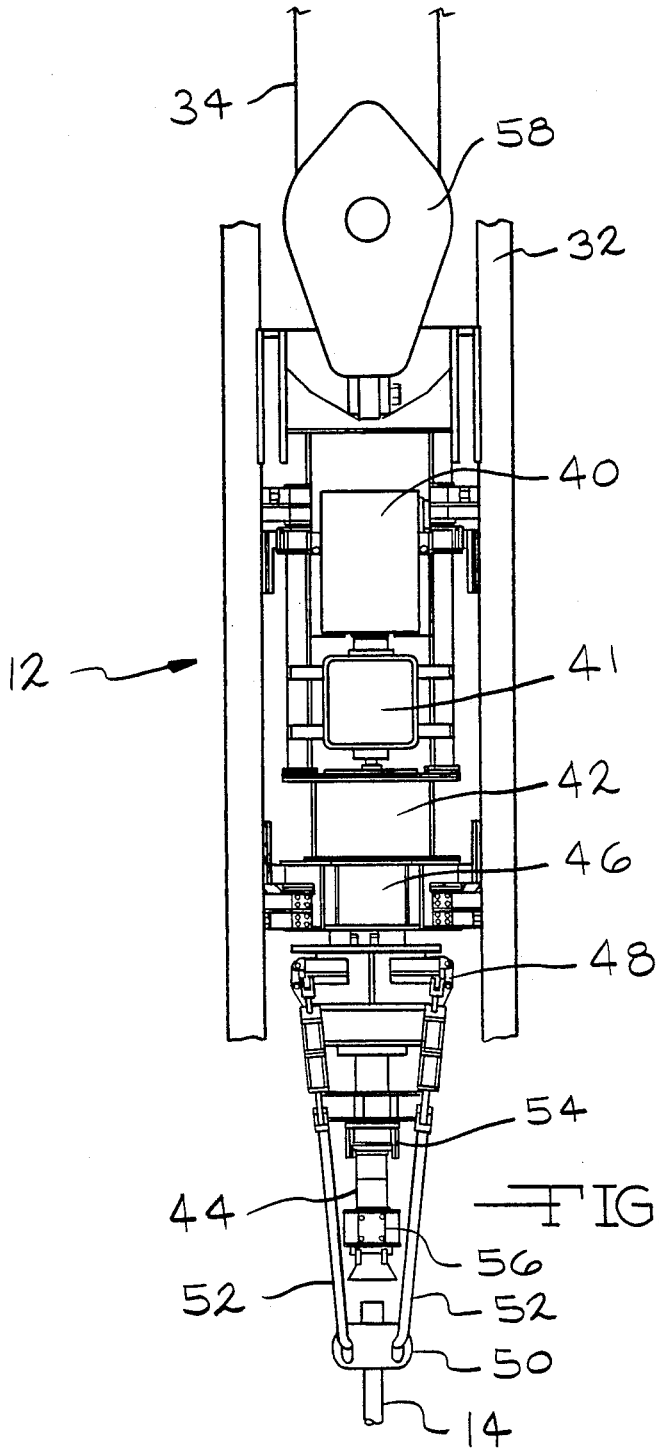
FIG. 2 is a schematic view showing the power swivel of FIG. 1 supported by a pair of guide tracks.

FIG. 2 shows details of power swivel 12 which generally includes a motor drive assembly for rotating drill string 18 and a handling system for supporting drill string 18. The motor drive assembly includes a drill motor 40, a swivel bearing 42 and a sub assembly 44 for threadably connecting drill motor 40 to drill pipe 14. The handling system includes a housing 46 for supporting swivel bearing 42, a handling ring 48, an elevator 50 for supporting pipe 14, and a pair of elevator links 52 for suspending elevator 50 from handling ring 48. A make-break device 54 and grabs 56 are supported by handling ring 48 for connecting and disconnecting sub assembly 44 to pipe 14. The handling system also includes a traveling block 58 and a pair of support links (not shown) for suspending housing 46 from traveling block 58.

Power swivel 12 is remotely operated from a console (not shown) on rig floor 26. Power swivel 12 is lifted or lowered by traveling block 58 within derrick 24 and well 20 is deepened by the powered rotation of drill pipe 14 by drill motor 40. Power swivel 12 is guided by tracks 32 and the torque generated by drill motor 40 is resisted by tracks 32 and derrick 24.

Figure 3:
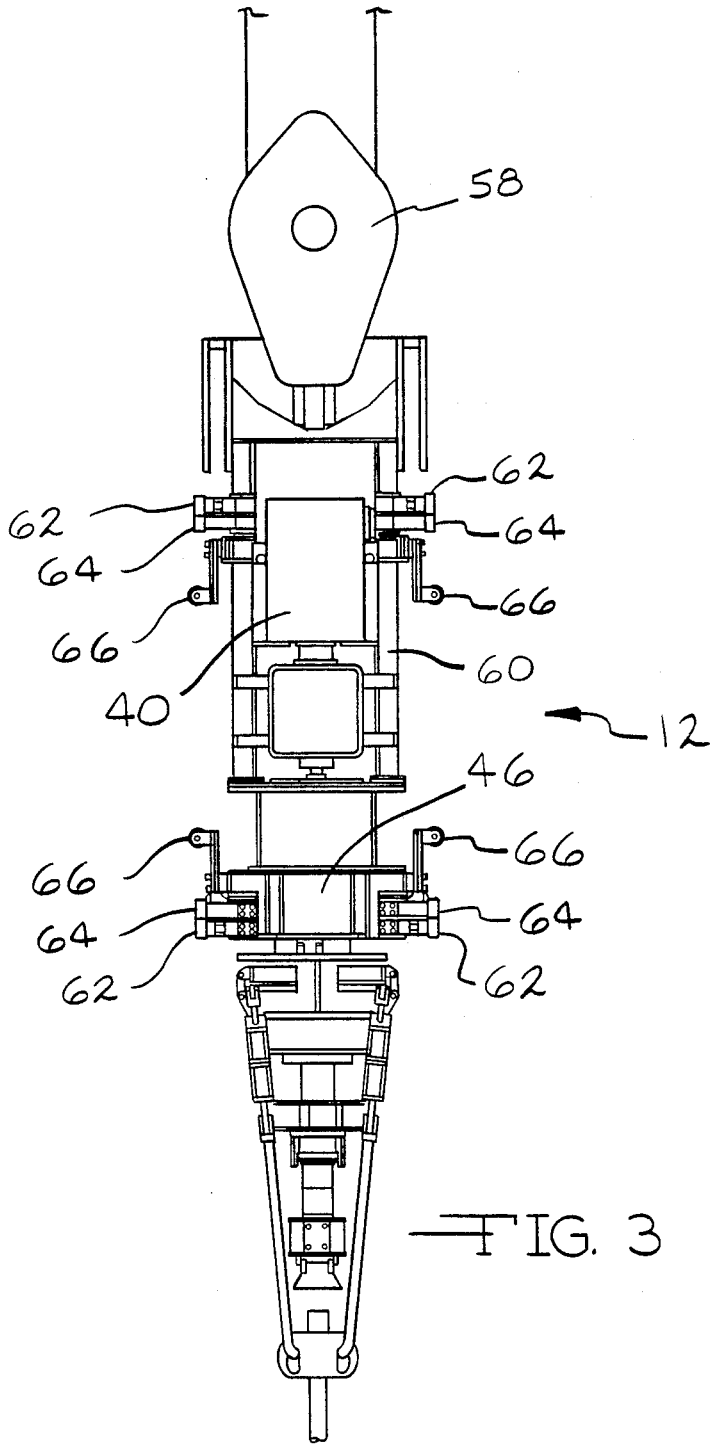
FIG. 3 is the same as FIG. 2 except the guide tracks have been removed.

FIG. 3 shows power swivel 12 of FIG. 2 with tracks 32 removed to show the preferred arrangement of the guide means including an adjacent pair of rotatably mounted rollers 62,64 and a rotatably mounted roller 66 positioned against each track 32 at or above drill motor 40. A similar arrangement of rollers is shown positioned on swivel bearing housing 46.

Figure 4:
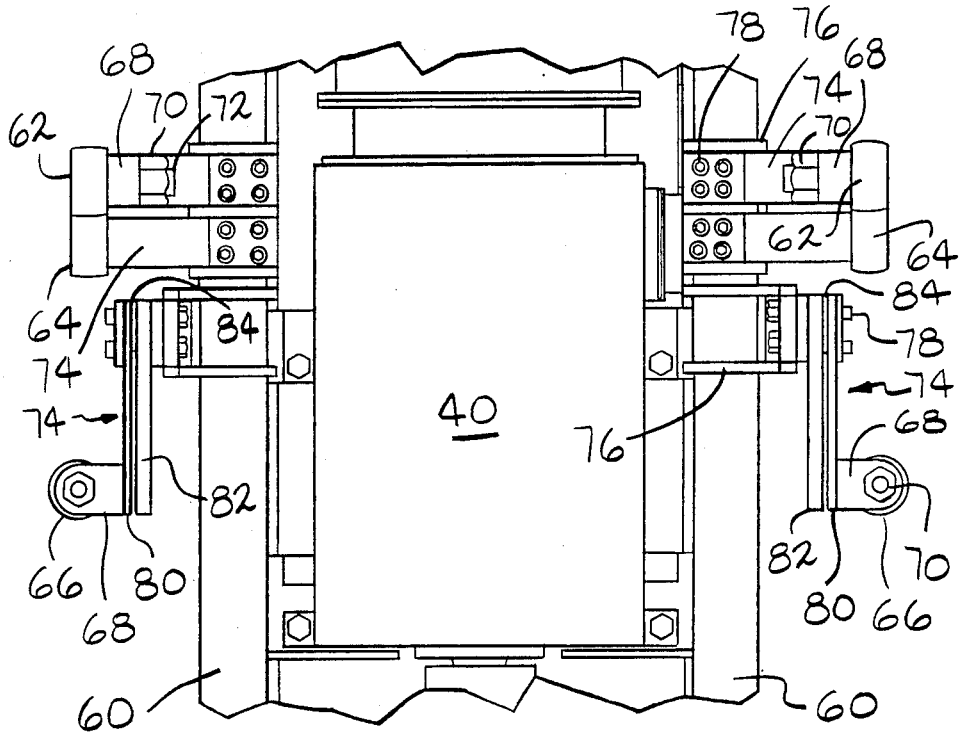
FIG. 4 is a schematic view showing detail of the upper portion of the power swivel with upper guide rollers.
Figure 5:
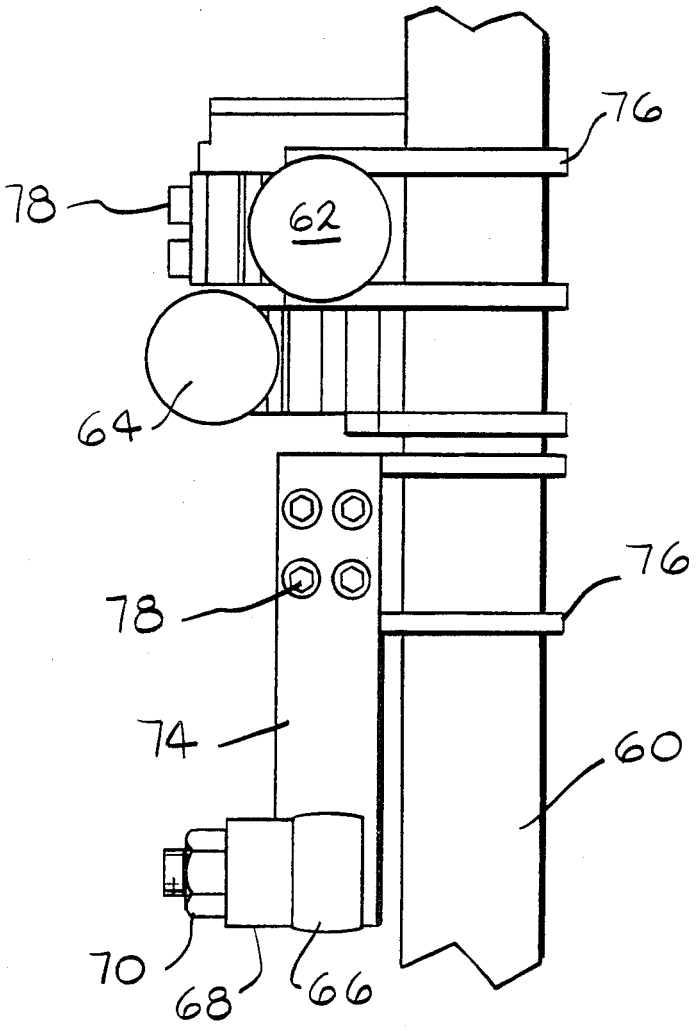
FIG. 5 is a side view of the guide rollers shown in FIG. 4.

FIG. 4 shows detail of the upper guide means in FIG. 3. FIG. 3 illustrates a symmetrical assembly on opposite sides of drill motor 40 and a similar assembly mounted on housing 46. Since each assembly of rollers is an allochiral arrangement, an explanation for any one assembly applies equally to the remaining ones. Roller 66 is mounted to a stanchion 68 by a nut 70 secured to a threaded bolt 72. Stanchion 68 is fastened, such as by welding or bolting, to a spring 74 which is secured to a frame 60 by a bracket 76 and fasteners 78. Rollers 62,64 are similarly mounted onto springs 74 by stanchions 68. Spring 74 preferably is a composite of two leaf springs 80,82 which are spaced apart by a shim 84.

Composite springs, or multiple stage springs, are preferably used because primary spring 80 is relatively weak and provides only limited resistance to rotation of power swivel 12. This allows power swivel 12 to move under light loads and insures that rollers 62,64,66 have only minimal loading at positions where they are "pinched" into a space smaller than their normal spacing. Primary springs 80 are too small to fully dissipate the energy required to reduce the torque loading and secondary springs 82 are provided for this purpose. Thus, power swivel 12 is resisted by weaker primary spring 80 in the initial part of the travel by power swivel 12. After a predetermined amount of travel, power swivel 12 is resisted by the combination of spring 80 and spring 82. Primary spring 80 is mostly to accommodate abberations in tracks 32 and secondary spring 82 is mostly for dissipating torque loads of power swivel 12.

It will be understood various materials can be used for the springs. For example, several steel alloy compositions having various heat treated conditions being possible. In some situations, natural rubber, synthetic rubber, or a graphite-epoxy composite may be desirable. Depending on geometry and space requirements of the power swivel, any one of such springs as Belleville, gas, liquid, coil or torsional could also be used. The critical requirement for the spring is that it exert the required amount of force over the required amount of deflection. Those skilled in the art refer to this as "spring rate" (force per unit length of travel) with the spring rate for each design being easy to determine.

Figure 6:
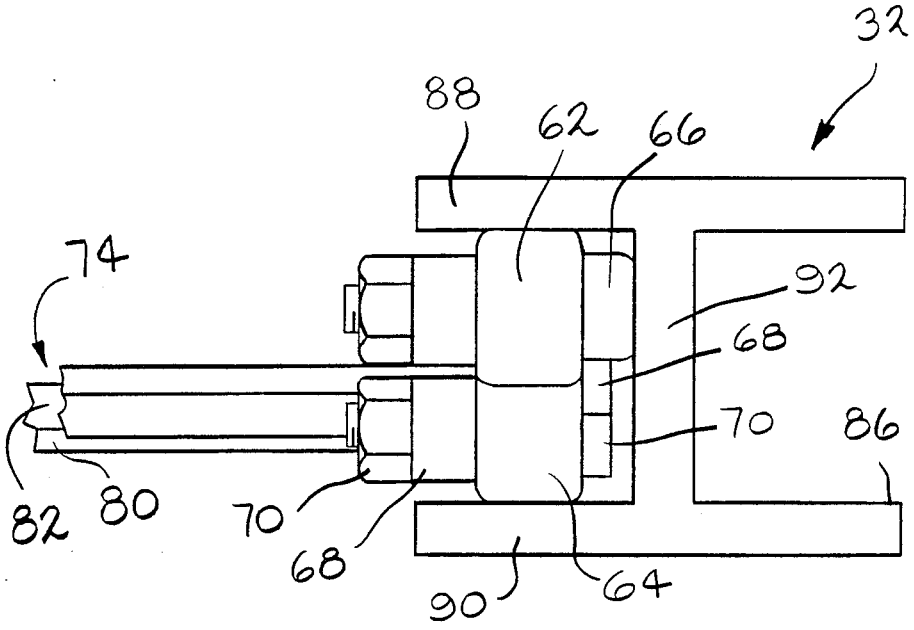
FIG. 6 is a top view of the guide rollers shown in FIGS. 4 or 5 when suspended within an H-beam.

FIG. 6 shows a top view of a guide assembly within track 32. Track 32 is an H-beam 86 including a pair of spaced flanges 88,90 integral with a web 92. Those skilled in the art will appreciate that various other structural members such as square tubing, rectangular tubing, and the like could also be used as track 32. Rollers 62,64 are urged against flanges 88,90 respectively and roller 66 is urged against web 92. Deflection of tracks 32 resulting from torque of drill motor 40 or misalignment of tracks 32 resulting from environment stress can cause rigidly mounted rollers of the prior art to become disengaged from tracks 32. This causes increased wear if the rollers bind or rebound between tracks 32. Springs 74 of the invention act as shock absorbers allowing power swivel 12 limited motion while being guided by tracks 32.

Figure 7A:
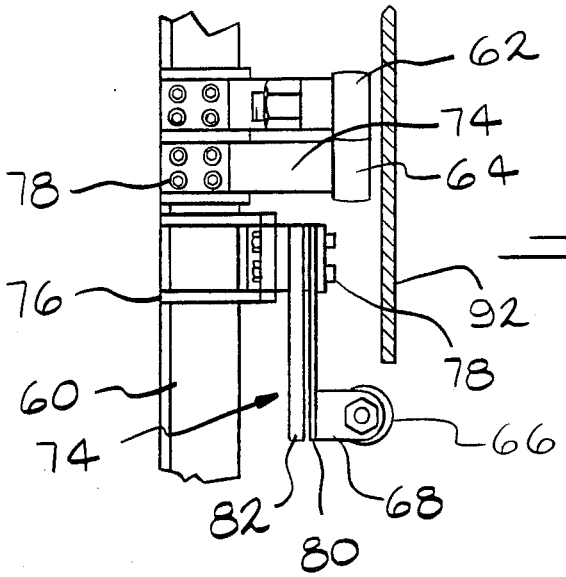
FIGS. 7*a* and 7*b* are schematic views illustrating how the power swivel is supported by the guide rollers.
Figure 7B:
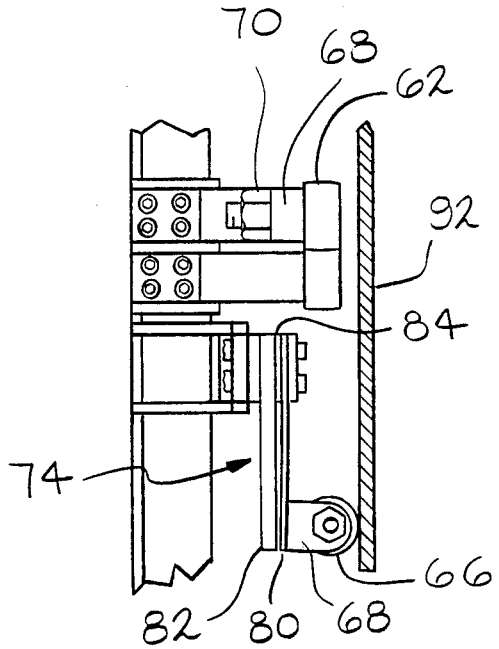

FIGS. 7*a* and 7*b* are similar to FIG. 4 except a cross-section of web 92 of track 32 is shown. FIGS. 7*a* and 7*b* illustrate how springs 74 maintain rollers 62,64,66 into continuous rolling contact with track 32. FIG. 7*a* shows the relationship of roller 66 relative to web 92 before power swivel 12 is installed onto tracks 32. The length of stanchion 68 is greater than the spacing between spring 74 and web 92. FIG. 7*b* shows power swivel 12 installed onto tracks 32. When power swivel 12 is mounted onto tracks 32 and roller 66 contacts web 92, primary leaf spring 80 of spring 74 is slightly flexed or bent away from web 92 to its normal or biased position toward (but not quite touching) secondary spring 82. As indicated above, yielding of primary spring 80 should accommodate most abberations in tracks 32. During drilling, secondary spring 82 will also yield with the heavy torque load generated by drill motor 40 being resisted by the combination of springs 80 and 82. It will be understood rollers 62,64 will be similarly urged into contact with flanges 88,90.

A further embodiment of the invention is incorporation of a damping device (not shown) with the spring. The spring causes the power swivel to constantly do work as the power swivel moves. This work is recaptured as the power swivel moves in the opposite direction. A damping device also causes the power swivel to do work with this latter work converted to heat energy. Those skilled in the art of suspension systems will recognize the potential benefit of a single device which accomplishes both a spring function and a damping function. As with springs, the damping device could by any one of a liquid, gas or mechanical type with the common element being the ability of the device to convert mechanical energy to heat energy.

It will be understood various modifications may be made to the invention without departing from the spirit and scope of it. Therefore, the limits of the invention should be determined from the appended claims.

We claim:

1. A combination, comprising:
a power swivel suspended for vertical movement within a derrick,
said power swivel including a drill motor for rotating a drill string into a well,
means for guiding said power swivel during said vertical movement along a track,
said track fixed to said derrick and disposed parallel to the longitudinal axis of said well,
said track including a flange and a web,
said guide means including first and second springs each having first and second ends,
said first ends being rigidly connected to said power swivel,
each of said second ends having a roller journaled thereto,
said springs preloaded so that said rollers on said first spring yieldably engages said flange and said roller on said second spring yieldably engages said web,
whereby said springs prevent free rotation of said power swivel around said longitudinal axis during rotation of said drill string by said power swivel.

2. A combination, comprising:
a power swivel suspended for vertical movement within a derrick,
said power swivel including a drill motor for rotating a drill string into a well,
means for guiding said power swivel during said vertical movement along each of spaced tracks,
said tracks fixed to said derrick and disposed parallel to the longitudinal axis of said well,
each of said tracks including a flange and a web,
each of said guide means including first and second spring each having first and second ends,
said first ends being rigidly connected to said power swivel,
each of said second ends having a roller journaled thereto,
said springs preloaded so that said roller journaled to said first spring yieldably engages said flange and said roller journaled to said second spring yieldably engages said web,
whereby said springs prevent free rotation of said power swivel around said longitudinal axis during rotation of said drill string by said power swivel.

3. The apparatus of claim 2 wherein said first ends are connected to a frame for supporting said drill motor of said power swivel.

4. The apparatus of claim 2 wherein said flange and said web are substantially perpendicular to each other.

5. The apparatus of claim 4 wherein each of said tracks includes a pair of said flanges spaced from each other by said web.

6. The apparatus of claim 2 wherein said guide means include means for damping torque loads of said drill motor of said power swivel.

7. The apparatus of claim 2 wherein each said spring is a leaf spring.

8. The apparatus of claim 2 wherein each said leaf spring is a composite including a primary spring spaced apart from a secondary spring, 9. A combination comprising:
a power swivel suspended for vertical movement within a derrick,
said power swivel including a drill motor for rotating a drill string into a well,
means for guiding said power swivel during said vertical movement along a pair of spaced tracks,
said tracks fixed to said derricks and disposed parallel to the longitudinal axis of said well,
each of said tracks including a pair of flanges spaced from each other by a web,
each of said guide means including a plurality of leaf springs each having first and second ends,
said first ends being rigidly connected to said power swivel,
each of said second ends having a roller journaled thereto,
said springs preloaded so that said roller of one of said springs yieldably engages said web and said rollers of other of said springs yieldingly engage said flanges, whereby said springs prevent free rotation of said power swivel around said longitudinal axis during rotation of said drill string by said power swivel.

10. A combination, comprising:
a power swivel suspended for vertical movement within a derrick,
said power swivel including a motor drive assembly for rotating a drill string into a well and a pipe handling system,
upper means for guiding said drive assembly and lower means for guiding said handling system during said vertical movement along each of spaced tracks,
said tracks fixed to said derrick and disposed parallel to the longitudinal axis of said well,
each of said tracks including a flange and a web,
each of said guide means including first and second springs with each said spring including first and second ends,
said first ends of said springs of said upper guide means being rigidly connected to said drive assembly and said first ends of said springs of said lower guide means being rigidly connected to said handling system,
each of said second ends of said springs having a roller journaled thereto,
said springs preloaded so that said rollers on said first springs yieldably engage said flanges and said rollers on said second springs yieldably engage said webs,
whereby said springs prevent free rotation of said power swivel around said longitudinal axis during rotation of said drill string by said power swivel.

11. A combination, comprising:
a power swivel suspended for vertical movement within a derrick,
said power swivel including a motor drive assembly for rotating a drill string into a well and a pipe handling system,
upper means for guiding said drive assembly and lower means for guiding said handling system during said vertical movement along a pair of spaced tracks, said tracks fixed to said derrick and disposed parallel to the longitudinal axis of said well, each of said tracks including a pair of flanges spaced from each other by a web, each of said guide means including first and second leaf springs with each said spring including first and second ends, said first ends of said leaf springs of said upper guide means being rigidly connected to said drive assembly and said first ends of said leaf springs of said lower guide mans being rigidly connected to said handling system, each of said second ends of said leaf springs having a roller journaled thereto, said leaf springs preloaded so that said rollers journaled to said first leaf springs yieldably engage said flanges and said rollers journaled to said second leaf springs yieldably engage said webs, whereby said leaf springs prevent free rotation of said power swivel around said longitudinal axis during rotation of said drill string by said power swivel.

* * * * *